US006666782B1

(12) United States Patent
Wu

(10) Patent No.: US 6,666,782 B1
(45) Date of Patent: Dec. 23, 2003

(54) BLINKING SPHERICAL TOY

(76) Inventor: Li-Hsiung Wu, No. 28, Lane 171, San Min Road, Lu Zhou City, Taipei Hsien (TW)

( * ) Notice: Subject to any disclaimer, the term of this patent is extended or adjusted under 35 U.S.C. 154(b) by 0 days.

(21) Appl. No.: 10/437,036

(22) Filed: May 14, 2003

(30) Foreign Application Priority Data

Jan. 29, 2003 (TW) ..... 092201687

(51) Int. Cl.[7] ..... A63B 65/00
(52) U.S. Cl. ..... 473/570; 446/485; 446/242
(58) Field of Search ..... 446/71–76, 175, 446/242, 269, 484, 485; 473/570, 351, 354, 371, 609

(56) References Cited

U.S. PATENT DOCUMENTS 2,020,484 A * 11/1935 Turner
5,066,011 A * 11/1991 Dykstra et al. ..... 273/58 G
5,236,383 A * 8/1993 Connelly ..... 446/219
5,375,839 A * 12/1994 Pagani ..... 273/58 E
6,428,432 B1 * 8/2002 Kachel ..... 473/570
2001/0049311 A1 * 12/2001 Lewis et al. ..... 473/570

* cited by examiner

*Primary Examiner*—Jacob K. Ackun
*Assistant Examiner*—Jamila Williams
(74) *Attorney, Agent, or Firm*—Troxell Law Office PLLC

(57) ABSTRACT

The present invention discloses a blinking spherical toy, comprising an internal sphere composed of an upper hemisphere and a lower hemisphere, and the lower hemisphere having a circuit board with a circuit connecting to at least one lamp and one battery module, and two electrode rods passing through the bottom of the lower hemisphere; an external sphere having a size larger than the internal sphere and composed of a bottom hemisphere and a top hemisphere for accommodating the internal sphere, and a contact end disposed on both sides of the bottom axial line of the bottom sphere and passing through and being exposed from the bottom hemisphere. A non-conductive liquid is injected into the external sphere to fill the space between the internal sphere and the external sphere. By means of the gravitational force of the internal sphere, its upper sphere finally faces upward, and the two electrode rods of its lower sphere touch both contact ends. When a conductor is in contact with the two contact ends, an electric circuit is produced with the circuit board to light up the lamp or give a blinking effect.

9 Claims, 3 Drawing Sheets

BLINKING SPHERICAL TOY

BACKGROUND OF THE INVENTION

1. Field of the Invention

The present invention relates to a spherical toy, more particularly to a blinking spherical toy.

2. Description of the Related Art

A sphere plays an important role in children's toys, because a sphere is smooth and rollable, which much safer than other toys with angular shapes. Furthermore, the moving direction of a sphere is multi-directional and expectedly, therefore a sphere can satisfy children's curiosity.

For example, a common toy: a ball inside another ball carries a weight at the bottom of an internal ball, and a decorative pattern is printed on the upper section of the exterior of the ball. After the internal ball is placed inside a hemisphere of larger curvature, and the hemisphere is engaged with another hemisphere of same curvature, an external ball is made. A liquid is filled into the space between the two balls through a predetermined ball hole on the external ball and a plug seals the hole so that the liquid will not leak. When such toy is played, the external ball can be rolled in any direction, and the pattern on the internal ball always faces upward due to the movement of the liquid and the gravitational force of the weight at the bottom.

After such ball in another ball has been played for a while, the excitement disappears very soon and no longer attracts consumers. Therefore, toy manufacturers try to extend the life of such product, and intentionally combine a key chain or pen, etc with the spherical toy to give diversified functions and a more appealing appearance. For example, the inventor of this invention has been granted with a R.O.C. Utility Model Patent No. 135683 entitled "Rotary spherical toy" (foreign counterpart U.S. Pat. No. 5,893,789), which disclosed a novel idea for spherical toys.

SUMMARY OF THE INVENTION

The primary objective of the present invention is to provide a blinking spherical toy comprising an internal sphere with its lower hemisphere containing a battery module, a lamp, and a circuit board of related circuits, and the circuit being extended downward to two electrode poles and passing through the lower hemisphere; a transparent or semi-transparent upper hemisphere being engaged with the lower hemisphere, and the internal sphere being placed inside the external sphere, and both sides of the axial line on the external sphere having two electrically conductive ends; a bottom hemisphere being engaged with a top hemisphere to constitute the external sphere; a non-conductive liquid (oil liquid) being filled into the space between the external sphere and the internal sphere through a ball hole on the external sphere; a plug sealing the ball hole; by means of the gravitational force of the internal sphere, the upper hemisphere always facing upward and the two electrode rods being in contact with the contact ends. When a conductor is in contact with the two contact ends, it forms an electric circuit with the circuit board and lights up the lamp or makes the lamp to blink. Such structure is definitely a great idea and breaks through the traditional structure.

The secondary objective of the present invention is to provide a blinking spherical toy, wherein patterns are printed on the surface of the upper hemisphere of the internal sphere for enhancing the visual effect. In addition, the lower hemisphere of the internal sphere has at least one support member such as a support ring for supporting the circuit board. Further, a hollow axial pillar is disposed around the axial line at the bottom of the lower hemisphere of the internal sphere for passing the two electrode rods through and coupling to a weight in order to cope with the situation of insufficient gravitational force. In addition, the non-conductive liquid is an oil liquid.

In view of the above description, the inventor of the present invention based on years of experience accumulated from the engagement in the related industry conducted extensive research and experiments to resolve the shortcomings of the prior-art spherical toy structure and invented the "Blinking Spherical Toy" according to the present invention.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
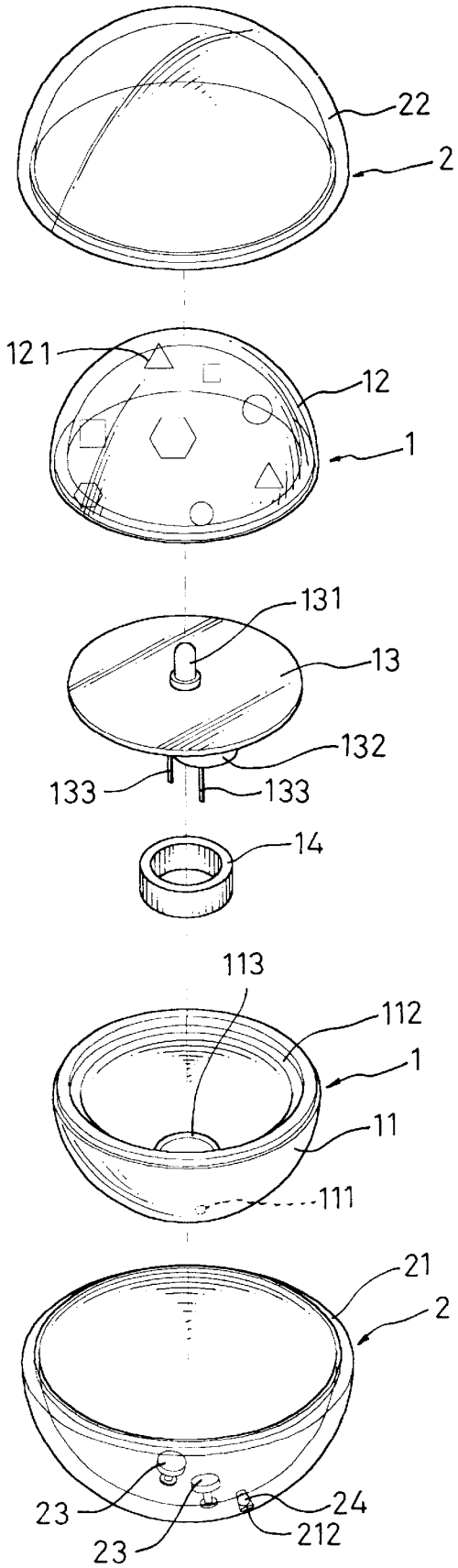
FIG. 1 is a perspective diagram of the disassembled parts of the spherical toy according to the present invention.
Figure 2:
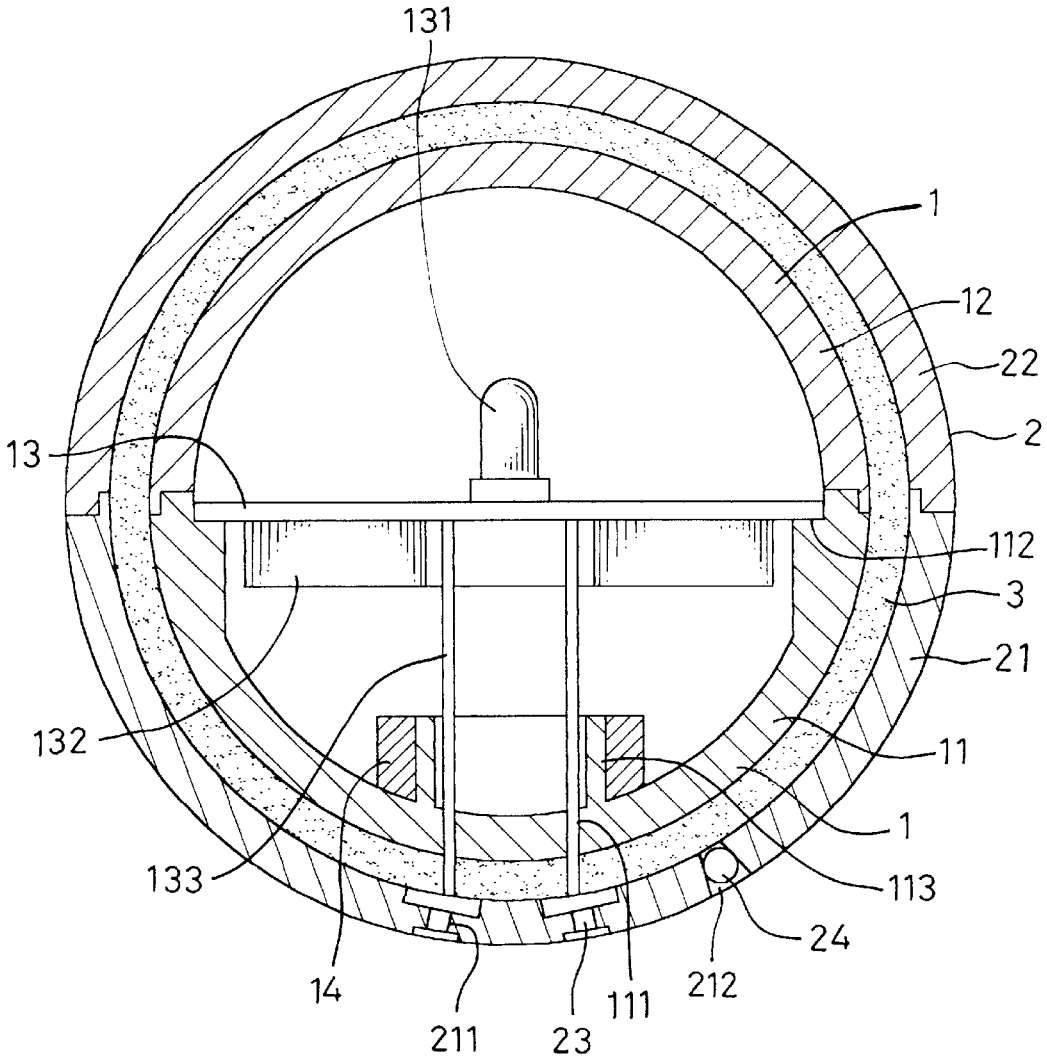
FIG. 2 is a cross-sectional diagram of the assembled structure according to the present invention.

Please refer to FIGS. 1 and 2 for the present invention. The blinking spherical toy of the present invention comprises an internal sphere 1, an external sphere 2, and a non-conductive liquid 3; wherein the internal sphere 1 is composed of a lower hemisphere 11 and an upper hemisphere 12 engaged with each other. Since transparency is taken into consideration, the upper hemisphere 12 is made of transparent or semi-transparent plastic materials such as acrylic. The present invention is characterized in that the lower hemisphere 11 comprises a circuit board 13, and such circuit board is electrically coupled to at least one lamp 131 and a battery module 132, and its bottom has two electrode rods 133 passing through two predetermined rod holes 111 disposed on the lower hemisphere 11 to seal the rod holes 111 with a traditional sealing method such as using a glue to seal the hole in order to assure that the non-conductive liquid 3 such as an oil will not leak into the internal sphere 1. Further, in order to secure the circuit board 13 into a fixed position, at least one support member 112 such as a support ring is disposed at the periphery of the lower hemisphere 11 for supporting the circuit board. Furthermore, in order to increase the gravitational force of the internal sphere 1, a hollow axial pillar 113 is protruded from the periphery of the axial line at the bottom of the lower hemisphere 11 for passing the two electrode rods 133 through and also for connecting a weight ring 14 to shift the center of gravity of the internal sphere 1 down.

Further, a decorative pattern 121 is printed on the surface of the upper hemisphere 12 to enhance the visual effect.

The external sphere 2 slightly larger than the internal sphere 1 is composed of a bottom hemisphere 21 and a top hemisphere 22. The present invention is characterized in that the bottom hemisphere 21 has two conductive contact ends 23 on both sides of the axial line at its bottom of the bottom hemisphere 21 as shown in the figure. Each contact end 23 passes through a predetermined end hole 211 at the bottom hemisphere 21 and is exposed from the bottom hemisphere

21. The two end holes are sealed with traditional sealing technology and thus not described in details here. The assembling of the foregoing components constitutes the external sphere 2 of the present invention. Finally, a non-conductive liquid 3 such as an oil liquid is injected through the ball hole 212 of an external sphere 2 to fill the space between the internal sphere 1 and the external sphere 2. A plug 24 is used to seal the ball hole 212 and complete the assembling of the present invention.

Figure 3:
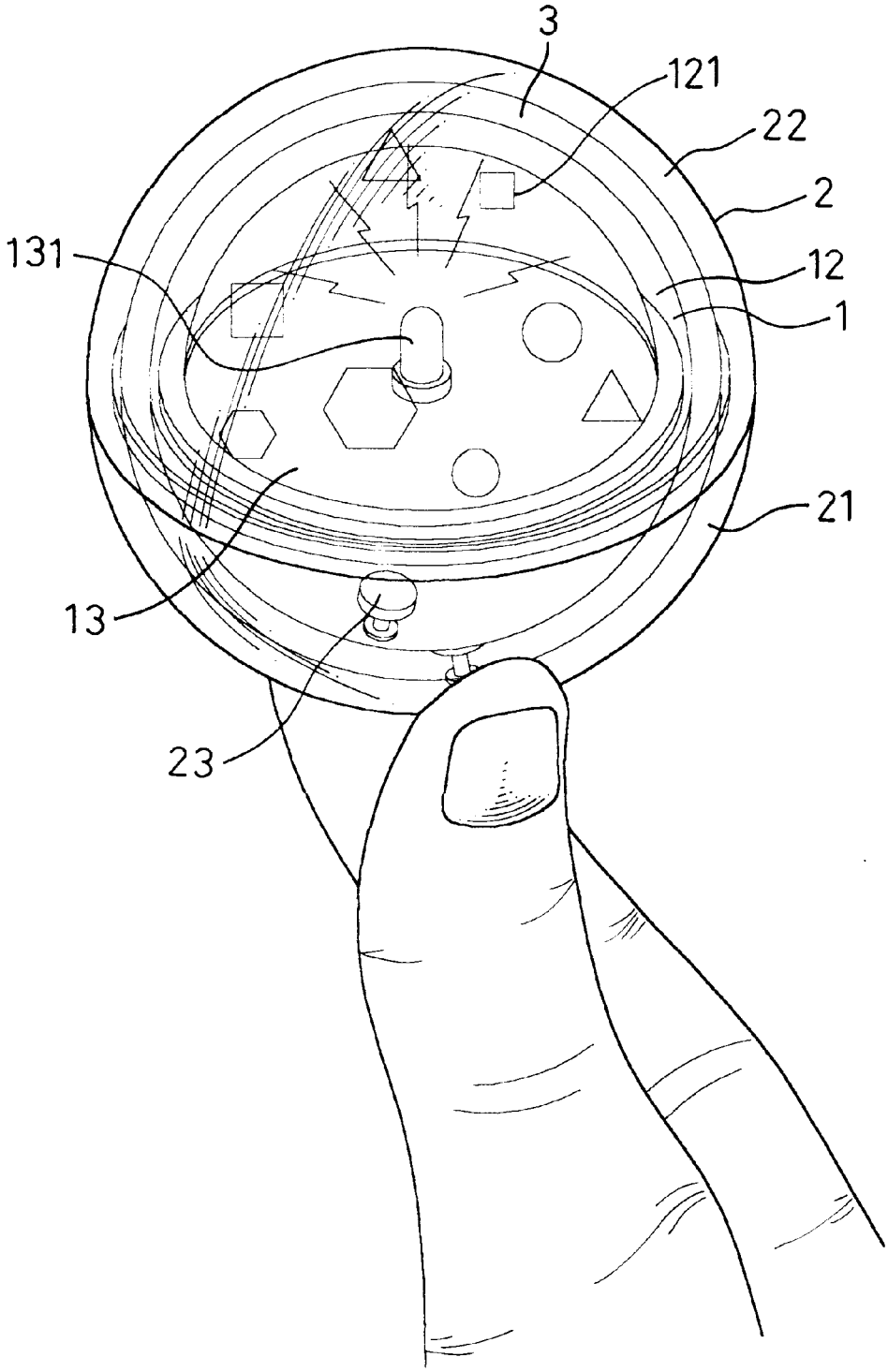
FIG. 3 is a perspective diagram of the assembled spherical toy of the present invention during its operation.

Please refer to FIG. 3. The internal sphere 1 attaches the bottom of the external sphere 2 due to the gravitational force. Therefore, no mater how the spheres are rolling or shaking, the upper hemisphere 12 with the decorative pattern 121 remains facing upward. When a player touches the two contact ends 23 by a finger (or a conductive object), it forms an electric circuit with the circuit board 13 to light up or blink a lamp such as a LED lamp. Besides having more the fun with the spherical toy, it also enhances the visual effect, and is definitely a great idea for objects of similar types.

While the present invention has been described by practical and preferred embodiments, it is understood that this invention is not limited to the disclosed embodiments but is intended to cover various arrangements included within the spirit and scope of the broadest interpretations and equivalent arrangements.

What is claimed is:

1. A blinking spherical toy, comprising:

an internal sphere, composed of an upper hemisphere and a lower hemisphere, and said lower hemisphere having a circuit board therein, and its circuit being electrically coupled to at least one lamp and a battery module, and two electrode rods being extended from the bottom and passing through said lower hemisphere;

an external sphere, being larger than said internal sphere and composed of a bottom hemisphere and a top hemisphere, for accommodating said internal sphere, and a contact end being disposed on both sides of an axial line at the bottom of said bottom hemisphere and passing through and being exposed from the bottom hemisphere, and a non-conductive liquid being injected into said external sphere to fill the space between said internal and external spheres;

by means of the action of gravitational force, said upper hemisphere remaining facing upward, and the two electrode rods of said lower hemisphere being in contact with said two contact ends to produce an electric circuit and light up the lamp and make the lamp to blink.

2. The blinking spherical toy of claim 1, wherein said upper hemisphere of the internal sphere is one selected from the group consisting of a transparent sphere and a semi-transparent sphere.

3. The blinking spherical toy of claim 1, wherein said upper hemisphere of the internal sphere has a decorative pattern on its surface.

4. The blinking spherical toy of claim 1, wherein said lower hemisphere of the internal sphere at its periphery has at least one support member for supporting said circuit board.

5. The blinking spherical toy of claim 4, wherein said support member is a support ring.

6. The blinking spherical toy of claim 1, wherein said lower hemisphere of the internal sphere has a hollow axial pillar disposed at the periphery of the axial line at the bottom of said lower hemisphere for passing through said two electrode rods and connecting to a weight ring.

7. The blinking spherical toy of claim 1, wherein said non-conductive liquid is an oil liquid.

8. The blinking spherical toy of claim 1, wherein said external sphere comprises a ball hole for injecting said non-conductive liquid, and a plug for sealing said ball hole.

9. The blinking spherical toy of claim 1, wherein said upper lamp is a LED lamp.

* * * * *